F6966 XR 4,568,351

United States Patent [19]

Palleiro Cardona et al.

[11] Patent Number: 4,568,351

[45] Date of Patent: Feb. 4, 1986

[54] USE OF CERTAIN ESTERS AS PH REGULATORS IN TEXTILE FINISHING PROCESSES

[75] Inventors: José M. Palleiro Cardona, Barcelona, Spain; Karl-Heinz Weible, Aesch, Switzerland

[73] Assignee: Sandoz Ltd., Basel, Switzerland

[21] Appl. No.: 611,323

[22] Filed: May 17, 1984

[30] Foreign Application Priority Data

May 23, 1983 [GB] United Kingdom ..... 8314180

[51] Int. Cl.[4] ..... D06P 1/64; D06M 13/16; D06M 11/04

[52] U.S. Cl. ..... 8/582; 8/101; 8/108 R; 8/531; 8/532; 8/533; 8/609; 8/638; 8/654; 8/657; 8/680; 8/685; 8/921; 8/922; 8/924

[58] Field of Search ..... 8/582, 609

[56] References Cited

U.S. PATENT DOCUMENTS

| | | | |
|---|---|---|---|
| 1,970,578 | 8/1934 | Schoeller et al. | 8/127 |
| 2,183,853 | 12/1939 | Haussmann et al. | 8/137 |
| 2,341,420 | 2/1944 | Bartlett | 560/232 |
| 2,677,700 | 5/1954 | Jackson et al. | 8/108 R |
| 2,901,311 | 8/1959 | Nusslein et al. | 8/445 |
| 3,975,515 | 8/1976 | Wajaroff et al. | 424/72 |
| 4,168,142 | 9/1979 | Hervot et al. | 8/101 |

*Primary Examiner*—A. Lionel Clingman

*Attorney, Agent, or Firm*—Gerald D. Sharkin; Richard E. Vila; Thomas C. Doyle

[57] ABSTRACT

A textile finishing process in which there is employed, as a pH regulator, a compound or a mixture of compounds of formula I $$R{-}CO{-}[O{-}A]_p{-}O{-}R' \qquad \text{I}$$

in which p is from 1 to 20,

R is hydrogen, $C_{1-3}$alkyl or $C_{1-3}$alkyl substituted by hydroxy

R′ has independently one of the significances given for R or is —CO—R and

A is $-CH_2CH_2-$; $-CH_2-CH_2-CH_2-$;

$$-CH_2-\underset{\underset{CH_3}{|}}{CH}- \text{ or } -CH_2-\underset{\underset{OH}{|}}{CH}-CH_2-.$$

27 Claims, No Drawings

USE OF CERTAIN ESTERS AS PH REGULATORS IN TEXTILE FINISHING PROCESSES

The present invention relates to a textile treatment process.

According to the present invention, there is provided a textile finishing process in which there is employed, as pH regulator, a compound or a mixture of compounds of formula I $$R—CO\left[O—A\right]_pO—R' \qquad \text{I}$$

in which p is from 1 to 20;

R is hydrogen, $C_{1-3}$alkyl or $C_{1-3}$alkyl substituted by hydroxy;

R' has independently one of the significances given for R or is —CO—R; and

A is $—CH_2CH_2—$; $—CH_2CH_2—CH_2—$;

$$—CH_2—\underset{\underset{CH_3}{|}}{CH}— \text{ or } —CH_2—\underset{\underset{OH}{|}}{CH}—CH_2—.$$

In the compounds of formula I p, which may be non-integral, represents the average value of the number of —O—A— units. p is preferably 1 to 6, more preferably 1 to 2. Any alkyl as R or R' is preferably methyl or ethyl. The preferred hydroxy substituted $C_{1-3}$alkyl group is $\beta$-hydroxy-ethyl.

R is preferably hydrogen or methyl.

R' is preferably hydrogen or formyl.

A is preferably ethylene or 1,2-propylene, more preferably ethylene.

The compounds of formula I are either known or may be obtained in conventional manner from available starting materials. For example they may be obtained by reacting a compound of formula II $$R—COOH \qquad \text{II}$$

in which R is as defined above, or a reactive functional derivative thereof with a compound of formula III $$H\left[O—A\right]_pO—R' \qquad \text{III}$$

in which A, R' and p are as defined above.

As will be appreciated, where the compound of formula III is a diol, a mixture of products will probably be obtained, i.e. of a compound of formula I wherein R' is hydrogen together with a compound of formula I wherein R' is —CO—R. Such mixtures may, if desired, be separated or may be used as such in the process of the invention.

The reaction of the compound of formula II or a reactive functional derivative thereof, e.g. an acid chloride or an anhydride with the compound of formula III may be carried out in conventional manner, e.g. at a temperature of from 80° to 160° C. over 3 to 7 hours, suitably the temperature being raised progressively throughout the reaction.

The compound of formula I wherein A is $$—(CH_2)_2— \text{ or } —\overset{\overset{CH_3}{|}}{CH}—CH_2—$$

may also be produced by reacting a compound of formula II with p moles ethylene or propylene oxide. Such a reaction can be carried out according to known methods. Preferably the reaction is carried out at a temperature from 60° to 180° C. in the presence of a catalyst, e.g. sodium or potassium hydroxide or acetate or sulphuric acid. As already indicated above, a mixture of mono-esters and di-esters of formula I may be obtained.

According to other alternatives, mixtures comprising mainly either ethylene glycol monoformiate or propylene glycol diformiate can be obtained by reacting ethylene glycol or propylene glycol with carbon monoxide at a temperature from 70° to 100° C. and under pressure, e.g. as described in U.S. Pat. No. 2,341,420. Ethylene glycol diformiate may also be produced by azeotropic distillation of a mixture of ethylene glycol, formic acid, isopropyl formiate in the presence of p-toluene-sulphonic acid, e.g. as disclosed in German Pat. No. 721 300.

Depending on the reaction or the procedure conditions selected, or after purification of the final product according to known methods, pure mono- or di-esters or mixtures of mono- and di-esters in various ratios can be specifically produced. The expression "mono- and di-esters" may also include the monoalkylene as well the polyalkylene esters.

The compounds of formula I, in the textile finishing process of the invention, act as acid generators, the acid arising from their hydrolysis in the finishing liquor. The use of compounds of formula I enables finishing to be carried out at a variable pH at either constant or variable temperature. In general, the compounds are employed to bring about a gradual reduction of the pH of the finishing liquor, e.g. in cases where the finishing agent performs its function or is fixed under acid conditions. This gradual reduction in pH causes the finishing agent to perform its function or become fixed progressively, leading to more regular results. However, the compounds may alternatively be used for stabilising the pH of an acid finishing liquor e.g. where there is a tendency for the pH to rise, (e.g. where industrial water is employed containing alkaline salts which, by dissociation, would cause alkalinisation of the liquor) or where pH variation must be slight and precise having regard to the instability of the finishing agent employed.

The substrates on which the process of the invention is suitably carried out are substrates which lend themselves to finishing under acid conditions. As examples may be given substrates comprising or consisting of cellulose hemipentaacetate, diacetate or triacetate, of optionally modified polypropylene, polyester or polyacrylonitrile, and in particular of natural and synthetic polyamide. The substrate may be a blend, e.g. of a mixture of polyamides or of a polyamide or polyester with one of the cellulosic fibres. The substrate may be in any conventional form, e.g. fibre, filament, yarns, chips, woven, non-woven, or carpet form.

By "finishing" as used herein, is intended to be included dyeing, printing, optical brightening, bleaching, chlorination of a wool containing substrate and, indeed, any conventional textile treatment process needing acid conditions for the agents employed to perform their function, dyeing, bleaching and chlorination being of particular interest.

In dyeing, the dyes employed may, for example, be acid dyes, metal complex dyes, particularly 1:2 metal complex dyes, disperse dyes, reactive dyes and basic dyes.

The rate at which the pH of the finishing liquor is reduced in the process of the invention or the accuracy by which the pH is maintained, depends on such factors as the rate of hydrolysis of the particular compound of formula I chosen, the temperature of the liquor, the rate at which the temperature of the liquor is raised, the concentration of the compound or mixture of compounds of formula I employed and the initial pH of the liquor.

The process of the invention is applicable to a wide variety of operating procedures, e.g. discontinuous and continuous finishing procedures, particularly dyeing procedures, to the so-called "Space-Dyeing" process and to printing processes, the acids conventionally used in such processes being replaced by the compounds of formula I.

Depending on the nature of the finishing agent employed, the process of the invention may be carried out at relatively low temperatures, e.g. from 20° to 50° C., at elevated temperatures, e.g. from 50° to 100° C., advantageously between 70° and 100° C. and particularly between 80° and 98° C., and at high temperatures, e.g. up to 190° C., preferably between 100° and 140° C. as in beam dyeing.

A preferred dyeing process is exhaust dyeing, particularly at a temperature from 20° to 98° C.

In dyeing processes, dye fixation can be effected at from 20° to 60° C., preferably from 20° to 40° C. over a period of from 6 to 48 hours, preferably 6 to 24 hours. Fixation may also be effected at high temperatures e.g. with saturated steam at 100° C. or with superheated steam up to 190° C., preferably from 140° to 160° C. or with dry air at from 120° to 300° C., preferably from 140° to 230° C.

When dyeing is performed by the exhaust method, no separate fixation step is needed since the fixation occurs during the exhaust treatment.

The amount of the compound or mixture of compounds of formula I employed in the process of the invention depends, in addition to the desired final pH, on the nature of the substrate and finishing agent and, in the case of dyeing, on the desired depth of shade. Depending on the amount of compound or mixture of compounds of formula I employed, the pH of the finishing liquor or bath may be held stable or reduced progressively over the course of treatment. In general good results are obtained when the compound of formula I or a mixture of compounds of formula I is added in an amount from 0.1 to 10 g/l, preferably from 0.1 to 6 g/l.

In general, and particularly in dyeing operations, the pH at the beginning of the process is between 5 and 11, preferably between 6 and 8 and, at termination is between 3 and 7, the bath at the end of treatment being either more acidic or at least of the same acidity as at the beginning. Generally the pH value has changed from 0 to 5 pH units, preferably from 2 to 4 pH units, over the treatment period.

The compound or mixture of compounds of formula I may be added at the beginning, during or at the end of the finishing process, in one or several additions or even continuously. Thus, in dyeing processes, the addition may be made at the beginning of dyeing, in the course of any temperature rise at any temperature holding stage and/or at the end of dyeing. Preferably, in dyeing processes, the compounds of formula I are added after the addition of the dyeing assistants and dyestuffs.

The terminal pH to be attained is dependent on the nature of the finishing agent used and the intensity of the finishing action desired, e.g. depth of shade in the case of dyeing. These pH values are known. When finishing a substrate comprising polyamides, the terminal pH can be accurately adjusted to such a value that the finishing bath is substantially fully exhausted. This is of particular interest in the case of dyeing since it makes it possible to reuse the dyebath for subsequent dyeing after addition of the dyes and assistants and an optional adjustment to the starting pH value. The precise adjustment of the pH-value of the finishing bath is also of particular importance in the dyeing with acid dyes of differentially dyeable polyamide and with substrates comprising fibres dyeable with basic dyes and acid dyes where it is desired to carry out dyeing in the same bath with both types of dyes.

The compounds of formula I are substantially water-soluble and may be used alone or in form of a composition containing further additives, e.g. one or more emulsifying or dispersing agents. This agent may be of the non-ionic, anionic or amphoteric type and is preferably one enabling rapid emulsion formation and giving an emulsion stable to boiling. The preferred types are the non-ionic agents, e.g. polyalkoxylated, preferably polyethoxylated, aliphatic fatty $C_{4-18}$alcohols or alkyl-$C_{1-12}$-phenols. Preferably the compounds of formula I are used alone, without any dispersing or emulsifying aid.

One method of elevated temperature dyeing comprises impregnating a textile substrate for about 10 minutes with an aqueous bath containing the dyestuffs and the desired dyeing auxiliaries, for example a levelling agent, and, optionally, a basic compound to give an initial pH of from 7 to 8.5. The liquor to goods ratio may be any conventional in the art, e.g. from 1:1 to 50:1. The compound or mixture of compounds of formula I is then added to the bath which is then heated at the rate of 1.0° to 3.0° C. per minute and held at the boil for from 20 to 60 minutes.

According to another method of elevated temperature dyeing, particularly of a polyamide-containing substrate, the compound of formula I or mixture of compounds of formula I is added to the dyebath at such a rate that the pH varies continuously more particularly to the extent that one or more linear or non-linear time and temperature gradients are generated. The addition of a compound of formula I or of a mixture of compounds of formula I may be effected automatically from a dosage system with data processing control.

As will be appreciated, preliminary testing may be necessary to arrive at the optimum working conditions, e.g. the optimum amount and time of addition of the compounds of formula I to obtain the desired pH variation or control. Such preliminary procedures and adjustment when necessary are however, well within the skill of the man in the art.

The invention is further illustrated by the following Examples in which the temperatures are in degrees Centigrade. All parts and percentages are by weight.

EXAMPLE 1

A polyamide fabric is introduced into a horizontal autoclave loaded with water, the liquor to goods ratio being 10:1. The water is heated to 35°–40° and then the following ingredients are added:

2.5% of a commercially available levelling agent based on polyethoxylated fatty amines
0.332% of the dye C.I. Acid Orange 3
0.037% of the dye C.I. Acid Red 42, and
0.025% of the dye C.I. Acid Blue 277.

The pH of the dyebath is adjusted to 8.1. 10 Minutes later, 0.25 g/l of an acid regulator of formula I, e.g. an addition product of 1–2 moles ethylene oxide to 1 mole 85% formic acid (diluted between 1:10 and 1:20) are added to the dyebath which is then heated to 98° at the rate of 1–1.5°/min. This temperature of the dyebath is maintained for 40–45 minutes after which the fabric is treated in the usual way. A uniform beige dyeing and good bath exhaustion is obtained.

Immediately after addition of the compound of formula I, the pH is 7.3. The final pH is 4.8.

EXAMPLE 2

The procedure of Example 1 is repeated but the following ingredients are added:

1.00% of the levelling agent of Example 1
1.17% of the dye C.I. Acid Blue 113
0.69% of the dye C.I. Acid Blue 106, and
0.194% of the dye C.I. Acid Brown 248.

The pH of the dyebath is adjusted to 7.9. The acid regulator of formula I, e.g. an addition product of 1–2 moles ethylene oxide to 1 mole 85% formic acid, is added to the dyebath in an amount of 1 g/l.

A uniform navy dyeing is obtained.

Immediately after addition of the compound of formula I, the pH is 6.7. The final pH is 4.6.

EXAMPLE 3

The procedure of Example 1 is repeated but the following ingredients are added:

2.00% of the levelling agent of Example 1
0.38% of the dye C.I. Acid Yellow 79
0.37% of the dye C.I. Acid Blue 279, and
0.228% of the dye C.I. Acid Brown 248.

The initial pH of the dyebath is 7.8. The acid regulator of formula I, e.g. an addition product of 1–2 moles ethylene oxide to 1 mole 85% formic acid, is added to the dyebath in an amount of 0.5 g/l.

The green dyeing obtained is uniform with excellent tinctorial yield.

Immediately after addition of the compound of formula I, the pH drops to 7.7. The final pH is 5.5.

EXAMPLE 4

A polyamide 6 (deep dyeing) / polyamide 66 (regular dyeing) 50:50 (stripewise) loop carpet is dyed in a winch-beck at a liquor-to-goods ratio of 30:1, with a dyebath as follows:

0.5 parts ethoxylated fatty amine and
0.3 parts borax are added at 20° to 1000 parts water.
After stirring,
0.2% of the dyestuff C.I. Acid Orange 126,
0.15% of the dyestuff C.I. Acid Blue 80 and
0.19% of the dyestuff C.I. Acid Red 57 are added to the dyebath, which has a pH of 8.1. The % dyestuff are based on the weight of the substrate.

The dyebath is then heated to 50° and after addition of 1 part of the acid regulator of Example 1, the carpet is further dyed at 50° for 60 minutes. The final pH of the exhausted dyebath is 5. The resulting carpet is dyed in brown stripes, the deep dye polyamide 6 stripes having a deeper shade than the polyamide 66 stripes.

EXAMPLE 5

A polyamide 6 tufted velvet carpet is introduced at a liquor-to-goods ratio of 25:1 in a winch beck in 1000 parts water of 20° containing 0.3 parts sodium dodecyl benzene sulphonate, 0.4 parts ethoxylated fatty amine and 0.3 parts sodium carbonate. When the carpet is thoroughly wetted, 0.06% of the dyestuff C.I. Acid Orange 126,
0.03% of the dyestuff C.I. Acid Red 57 and
0.06% of the dyestuff C.I. Acid Blue 288 are added to the dyebath. The pH is 9.8. Dyeing is effected for 30 minutes at 20°. 0.7 Parts of the acid regulator of Example 1 are then added to the dyebath over a 5 minute course. The temperature of the dyebath is raised to 30° and dyeing is continued for one hour at 30°. The exhausted dyebath has a final pH of 6.0. The carpet is evenly dyed in a light beige shade.

EXAMPLE 6

A dyebath containing, per 1000 parts
0.37 parts of the dyestuff C.I. Acid Orange 156
0.16 parts of the dyestuff C.I. Acid Red 57
0.20 parts of the dyestuff C.I. Acid Blue 72
1.00 part alkylphenol polyglycol ether
1.20 parts benzyl alcohol
1.20 parts monophenyl glycol ether and
2.00 parts acid regulator of Example 1 is poured at 20° with a pick-up of 200% on a polyamide 66 staple fibre tufted velvet carpet. The pH of the dyebath is 7.5. The carpet is then rolled up, wrapped in a plastic sheet and rotated at 20° for 20 hours at a rotation speed of 3 rpm. Good dyeing results are obtained.

EXAMPLE 7

Wool gabardine is dyed in a winch-beck at a liquor-to-goods ratio of 25:1 as follows:

The bath is heated to 40° and then
10.0% sodium sulphate calc.
2.3% of the dyestuff C.I. Acid Yellow 61
0.2% of the dyestuff C.I. Acid Red 118, and
0.4% of the dyestuff C.I. Acid Blue 82 are added. After a good distribution of the dyestuffs, 2 parts (per 1000 parts) of the acid regulator of Example 1 are added to the dyebath. The pH is 6.5. The temperature of the dyebath is then raised to the boil at a rate of 1.5°/min and the wool substrate is dyed nearly at the boil for one hour. The dyebath is exhausted and has a pH of 4.5. A uniform olive dyeing is obtained.

EXAMPLE 8

Knitting wool yarn is introduced at a liquor-to-goods ratio of 25:1 in a bath of 30° containing, per 1000 parts, 0.5 parts of a commercially available wetting agent based on alkylphenol polyglycol ether sulphate and silicone oil, and 2 parts sodium sulphate calc. 10 minutes after the yarn is wetted, there are added to the bath 0.25 parts of a commercially available levelling agent based on a sulphated ethoxylated tallow fatty amine, then 0.18% of the dyestuff C.I. Reactive Yellow 39,
0.27% of the dyestuff C.I. Reactive Red 84
0.20% of the dyestuff C.I. Reactive Blue 69 and 1 part of an acid regulator of formula I produced by azeotropic distillation of a mixture of formic acid, isopropyl formiate and ethylene glycol according to German Pat. No. 721 300. The dyebath has a pH of 7.2 and is then heated to the boil over 40 minutes. Dyeing is continued at the boil for 30 minutes. At the end of the boiling time, the pH is 5.3 and the dyebath is substantially exhausted. The dyebath is cooled to 50° by the addition of cold water and then evacuated. After rinsing with cold water a yarn dyed in a uniform brown shade is obtained.

EXAMPLE 9

100 Parts loose degreased wool are introduced in 1000 parts water of 40°. After addition of 0.6 parts of a fatty alcohol polyglycol ether-carboxylate to the bath and a thorough wetting and de-aeration 0.05% of the dyestuff C.I. Acid Red 399, 0.18% of the dyestuff C.I. Acid Violet 128 and 0.8 parts of the acid regulator of Example 1 are then admixed. The pH is 6.8. The dyebath is heated to 80° at a rate of 2°/min and then to 95° at a rate of 0.5°/min and dyeing is effected at this temperature for 30 minutes. The exhausted bath has a pH of 5.5. An even red violet dyeing is obtained.

EXAMPLE 10

A Hercosett ® shrink proofed wool yarn is treated at 20° for 10 minutes with a bath containing, per 1000 parts, 0.5 parts sodium acetate and 0.5 parts of a levelling agent based on an amphoteric fatty amine polyglycol ether. The liquor-to-goods ratio is 20:1.

After addition of 0.65% of the dyestuff C.I. Reactive Yellow 25 and 1.4% of the dyestuff C.I. Reactive Blue 169 to the bath, there is added 1 part of an acid regulator of formula I produced by reacting 1–2 moles ethylene oxide with 1 mole anhydrous formic acid. The dye-bath is heated to 80° at a rate of 1°/min and then to 96° at a rate of 0.5°/min and dyeing is performed at this temperature for one hour. The pH at the beginning is 7.3 and drops at the end to 5.4. After cooling to 90° and addition of 2 parts of sodium tripolyphosphate, the bath is maintained at 90° for further 15 minutes. After cooling and rinsing, a wool yarn dyed in an even vivid green shade is obtained.

EXAMPLE 11

A polyamide 66 fabric is treated at a liquor-to-goods ratio of 30:1 with a bath containing, per 1000 parts 0.2 parts alkylphenol polyglycol ether 0.3 parts C.I. Fluorescent Brightener 234 and 1.0 part of the acid regulator of Example 10.

The temperature of the bath is raised to 95° over a course of 30 minutes and the treatment is continued at this temperature for 30 minutes. The initial pH is 6.5 and at the end of the treatment it is 3.3. The resulting fabric is uniformly brightened with a brilliant effect.

EXAMPLE 12

A light wool fabric (1/1-weaving) is introduced at 30° in a bath containing per 1000 parts, 1 part commercially available dichloroisocyanurate 2 parts of the acid regulator of Example 10 and 1 part nonylphenol polyglycol ether.

The liquor-to-goods ratio is 50:1.

After a treatment of 80 minutes with this chlorinating bath, the substrate is rinsed, treated with 0.3 parts sodium bisulphite and rinsed again.

An identical fabric is treated according to the same procedure but acetic acid is used instead of the acid regulator of Example 10. The chloric content of each treatment bath is measured by titration. The following results are obtained.

| Time (min) | Bath containing the acid regulator % chlorine | pH | Bath containing acetic acid % chlorine | pH |
|---|---|---|---|---|
| 0 | 100 | 6.7 | 100 | 4.0 |
| 20 | 55 | 6.2 | 22 | 3.9 |
| 40 | 32 | 5.9 | 10 | 3.8 |
| 60 | 16 | 5.8 | — | 3.7 |
| 80 | 5 | 5.7 | — | 3.7 |

The chlorination of wool in the presence of the acid regulator of formula I, compared with the chlorination in the presence of acetic acid, is significantly more uniform; it will result in significantly improved dyeings.

EXAMPLE 13

A desized mixed fabric of 67% polyester and 33% cotton is bleached at 40° at a liquor-to-goods ratio of 30:1 with a bath containing, per 1000 parts:

0.2 parts nonylphenol polyglycol ether and 2 parts 80% sodium chlorite.

When the fabric is thoroughly wetted, 3 parts of the acid regulator of Example 10 are added to the bleaching bath. The pH is 7.3. The bath is heated to 90° over a course of 30 minutes and maintained at 90° for 60 minutes. The pH at the end of the treatment is 3.9.

After rinsing the resulting fabric is uniformly bleached and free from seed impurities.

What is claimed is:

1. A textile finishing process in which there is employed, as a pH regulator, a compound or a mixture of compounds of formula I $$R—CO\left[O—A\right]_pO—R' \qquad \text{I}$$

in which p is from 1 to 6,

R is hydrogen, $C_{1-3}$alkyl or $C_{1-3}$alkyl substituted by hydroxy

R′ has independently one of the significances given for R or is —CO—R and

A is $—CH_2CH_2—$; $—CH_2—CH_2—CH_2—$;

$$—CH_2—\underset{\underset{CH_3}{|}}{CH}— \text{ or } —CH_2—\underset{\underset{OH}{|}}{CH}—CH_2—.$$

2. A process according to claim 1, wherein R in the compound of formula I is hydrogen or methyl.

3. A process according to claim 1, wherein R′ is hydrogen or formyl.

4. A process according to claim 1, wherein A is ethylene or 1,2-propylene.

5. A process according to claim 1, which is a dyeing process.

6. A process according to claim 1, which is a bleaching process.

7. A process according to claim 1, which is a chlorination process of a wool containing substrate.

8. A process according to claim 1, wherein the pH at the beginning of the process is between 5 and 11 and at the end thereof is between 3 and 7, there having been a drop in pH or maintenance of the pH caused at least partially by the use of the compound of formula I.

9. A process according to claim 1, wherein the compound of formula I is added to the finishing medium at the beginning, during or towards the end of the finishing process.

10. A process according to claim 1, wherein the compound of formula I is added to the finishing medium at the beginning, after the addition of the finishing agents or assistants.

11. A process according to claim 1, wherein the temperature of the finishing medium is raised during the process, the compound of formula I being added whilst the medium is at the relatively low beginning temperature.

12. In a textile finishing process wherein a textile substrate is treated with a finishing medium containing (1) a textile finishing agent which requires acid conditions to perform its finishing function or become fixed on the substrate and (2) a compound which regulates the pH of said medium by hydrolizing to an acid therein, the improvement which comprises employing as the pH regulating compound a compound or mixture of compounds of formula I $$R—CO\text{-}[O—A]_p O—R' \qquad I$$

in which p is from 1 to 6 ;

R is hydrogen, $C_{1-3}$alkyl or $C_{1-3}$alkyl substituted by hydroxy;

R′ has independently one of the significances given for R or is —CO—R; and

A is $—CH_2CH_2—$; $—CH_2CH_2—CH_2—$;

$$—CH_2—\underset{\underset{CH_3}{|}}{CH}— \text{ or } —CH_2—\underset{\underset{OH}{|}}{CH}—CH_2—.$$

13. A process according to claim 12 wherein, in formula I,

R is hydrogen, methyl, ethyl or β-hydroxy-ethyl and

R′ is hydrogen, methyl, ethyl, β-hydroxy-ethyl or —CO—R.

14. A process according to claim 13 wherein, in formula I,

A is ethylene or 1,2-propylene.

15. A process according to claim 14 wherein, in formula I,

R is hydrogen or methyl and

R′ is hydrogen or formyl.

16. A process according to claim 12 which is a dyeing, printing, optical brightening, bleaching or wool chlorination process.

17. A process according to claim 14 which is a dyeing, bleaching or wool chlorination process.

18. A process according to claim 14 wherein the compound or mixture of compounds of formula I is present in the finishing medium in an amount from 0.1 to 10 g/l.

19. A process according to claim 17 wherein the compound or mixture of compounds of formula I is present in the finishing medium in an amount from 0.1 to 6 g/l.

20. A process according to claim 16 wherein the pH at the beginning of the process is between 5 and 11 and at the end thereof is between 3 and 7, and the compound of formula I is present in an amount sufficient to cause by its hydrolysis a drop in pH or maintenance of pH.

21. A process according to claim 17 which is an exhaust dyeing process.

22. A process according to claim 21 wherein the substrate is natural or synthetic polyamide.

23. A process according the claim 15 wherein A is ethylene.

24. A process according to claim 20 wherein A is ethylene.

25. A process according to claim 23 wherein p is 1 to 2.

26. A process according to claim 24 wherein p is 1 to 2.

27. A process according to claim 25 wherein, R is methyl and R′ is hydrogen.

* * * * *